US009963884B1

(12) United States Patent
Clemens

(10) Patent No.: US 9,963,884 B1
(45) Date of Patent: May 8, 2018

(54) MODULAR BUILDING CONSTRUCTION SYSTEM AND METHOD

(71) Applicant: George A. Clemens, South Russell, OH (US)

(72) Inventor: George A. Clemens, South Russell, OH (US)

( * ) Notice: Subject to any disclaimer, the term of this patent is extended or adjusted under 35 U.S.C. 154(b) by 0 days. days.

(21) Appl. No.: 15/409,978

(22) Filed: Jan. 19, 2017

(51) Int. Cl.

| | |
|---|---|
| ***E04C 2/52*** | (2006.01) |
| ***E04F 13/08*** | (2006.01) |
| ***E04B 2/56*** | (2006.01) |
| ***E04B 1/62*** | (2006.01) |
| *E04B 2/58* | (2006.01) |

(52) U.S. Cl.
CPC ..... *E04F 13/08* (2013.01); *E04B 1/625* (2013.01); *E04B 2/56* (2013.01); *E04F 13/0875* (2013.01); *E04F 13/0889* (2013.01); *E04B 2/58* (2013.01)

(58) Field of Classification Search
CPC ... E04F 13/08; E04F 13/0875; E04F 13/0889; E04F 13/0823; E04B 1/625; E04B 2/56; E04B 2/58; E04B 1/40; E04B 2001/2481
See application file for complete search history.

(56) References Cited

U.S. PATENT DOCUMENTS

| | | | | |
|---|---|---|---|---|
| 2,356,309 | A | 8/1944 | Garbe | |
| 3,312,018 | A * | 4/1967 | Fourmanoit | E04B 1/24 52/126.1 |
| 3,559,357 | A * | 2/1971 | Lowe | E04B 1/18 403/230 |
| 4,015,399 | A | 4/1977 | Prins | |
| 4,330,974 | A | 5/1982 | Fleisch et al. | |
| 4,551,961 | A | 11/1985 | Kiselewski | |
| 4,704,835 | A | 11/1987 | Jordan | |
| 5,289,665 | A * | 3/1994 | Higgins | E04B 1/2403 211/191 |
| 6,050,045 | A | 4/2000 | Campbell | |
| 6,085,479 | A * | 7/2000 | Carver | E04B 1/14 52/270 |
| 6,098,367 | A * | 8/2000 | Fridman | E04B 2/58 52/645 |
| 6,418,689 | B1 | 7/2002 | Hacquard et al. | |
| 6,668,504 | B2 | 12/2003 | Hughart | |
| 6,807,784 | B2 | 10/2004 | Hsueh | |
| 7,509,776 | B2 | 3/2009 | Reisman | |
| 7,578,110 | B2 | 8/2009 | Jenkins | |
| 7,797,901 | B2 | 9/2010 | Near | |
| 8,286,401 | B2 | 10/2012 | Little, Jr. | |
| 8,695,310 | B2 | 4/2014 | Tremblay | |
| 8,887,459 | B2 | 11/2014 | Wheeler | |
| 8,959,859 | B2 | 2/2015 | Haan et al. | |
| 9,032,682 | B2 | 5/2015 | Knoll et al. | |
| 2008/0104901 | A1 | 5/2008 | Olvera | |
| 2008/0148656 | A1 | 6/2008 | Sestito | |
| 2009/0260311 | A1 * | 10/2009 | Boyer | E04F 13/0889 52/506.06 |

(Continued)

*Primary Examiner* — Brian D Mattei
(74) *Attorney, Agent, or Firm* — Fay Sharpe LLP

(57) ABSTRACT

A building construction system of includes a prefinished exterior weather-tight insulating skin (panel), a cavity and structural zone where electrical, mechanical, plumbing, HVAC, data/audio systems can run freely and be modified, and a prefinished interior wall panel which is easily removable allowing access to the cavity and structural zone. The exterior and interior panels are mounted to structural components and create the cavity therebetween.

20 Claims, 13 Drawing Sheets

(56) References Cited

U.S. PATENT DOCUMENTS

| | | | | |
|---|---|---|---|---|
| 2012/0096799 | A1* | 4/2012 | Wright | E04F 13/0816 52/578 |
| 2013/0074431 | A1* | 3/2013 | Croasdale | E04B 2/562 52/272 |
| 2015/0013258 | A1* | 1/2015 | Sawatzky | E04B 2/46 52/309.1 |
| 2015/0052840 | A1* | 2/2015 | Beaty | E06B 1/34 52/483.1 |
| 2015/0096251 | A1* | 4/2015 | McCandless | E04F 13/0807 52/404.3 |

* cited by examiner

N.T.S.

N.T.S.

3"=1'-0"

Full Scale

Full Scale 1 1/2"=1'-0"

1 1/2"=1'-0"

3"=1'-0"

3/4"=1'-0"

3/4"=1'-0"

3"=1'-0"

3"=1'-0"

3"=1'-0"

3"=1'-0"

3"=1'-0"

3"=1'-0"

MODULAR BUILDING CONSTRUCTION SYSTEM AND METHOD

BACKGROUND

The present exemplary embodiment relates to buildings. It finds particular application in conjunction with residential building systems, and will be described with particular reference thereto. However, it is to be appreciated that the present exemplary embodiment is also amenable to other like applications.

The slow integration over time of various building systems into the residential building technique of stud platform framing results in an inefficient and laborious construction technique. The dominant American residential building system—platform stud wall framing on 16" centers—derives from stud balloon framing developed in the latter part of the 1800s. At that time, modern building systems, including effective insulation, electricity, plumbing, and mechanical heating and cooling systems, did not generally exist. Similarly, telephone, television, audio and data wiring and delivery were also in the future. As such, incorporation of these features into platform stud wall framing has been an exercise in adapting these systems to work within the limitations of the existing building techniques.

For example, insulation within stud cavities is historically very leaky around edges and inherently inefficient, due to the 'thermal break' of the stud material itself which represents much more than 1½" thickness per 16" (9%) due to structural framing required to surround openings and create top and bottom plates within walls. In addition, openings for electrical wiring must be drilled through frequent studs and floor joist platforms. Plumbing supply, waste and vent piping requires further drilling through the framing members. In cold climates, plumbing is kept away from exterior walls due to freezing of pipes. Likewise, mechanical HVAC ducting or piping is extremely inefficient in exterior walls due to heat loss since it displaces insulation. Thus, each of these systems further compromise insulation value in exterior walls.

Another consideration is that telephone, TV, and AV systems change quite rapidly. In many cases, cabling associated with these systems is simply run exposed on the outside of buildings producing unsightly results.

Moreover, existing building approaches generally necessitate that such systems must be ripped out and discarded or abandoned when making systems changes or changes to the wall layout. In this regard, the interior gypsum board finish must be demolished to make any changes, leading to a huge waste of materials and waste disposal issues that create large environmental issues as landfills grow.

In addition to the aforementioned deficiencies, platform framed houses are finished in place, and are required to be maintained in the field, since all elements are permanently mounted and fastened together in piece-by-piece fashion. Installation of the moisture/air barrier and exterior wall finish (siding such as wood clapboard or shingles, vinyl siding, etc.) occurs after wall construction is complete, typically using ladders and jacks in full exposure to the weather. This is inefficient and relatively dangerous. House painting in the field to complete construction is equally inefficient and dangerous. It also requires specific temperature ranges and creates environmental damage from overspray and off-gassing.

Interior finishes (typically ½" thick to ⅝" thick gypsum board) are also permanently applied, then taped and mudded, then sanded and painted within the living spaces. The process is labor intensive and creates harmful moisture, fumes, and later off-gassing from the finished walls. Any significant changes to or within the walls requires destruction of the interior finish, creating huge amounts of waste as houses are 'gutted' for replacement of obsolete or worn-out systems components such as old wiring, ductwork, or plumbing. Changes to window or door openings require structural replacement of lintels/headers, leading to destruction of large wall areas around the work. Additions or large-scale changes also often require complete demolition and waste of affected areas.

BRIEF DESCRIPTION

The exemplary building construction system of the present disclosure overcomes the deficiencies of the prior art building systems by separating the building structural and system components into 1) a prefinished exterior weather-tight insulating skin (panel), 2) a cavity and structural zone where electrical, mechanical, plumbing, HVAC, data/audio systems can run freely and be modified, and 3) a prefinished interior wall panel which is easily removable allowing access to the cavity and structural zone. The exterior and interior panels are mounted to structural components and create the cavity therebetween.

The present exemplary building construction system addresses exterior weather conditions such as cold, rain, and snow. Exterior wall panels are insulated but also are manufactured with a siding and air-and-moisture barrier underlayment. Horizontal joints in the exterior wall panels use accepted overlap, pressure-equalization-chamber, and upstand techniques to repel the elements. Vertical joints in the exterior panels have a vertical standard closure element that covers fasteners and has a sealant joint with the adjacent panels. Underlayment on adjacent panels can be sealed together with self-adhering membrane flashing.

The interior-side wall panels can be accessed more frequently by owners/users, not typically requiring professional involvement. In an exemplary embodiment, the interior wall panels are removable from the bottom upward, allowing easy access to the electrical/data/heating systems most frequently changed. Floods or water leakage into wall cavities is easily addressed and water-damaged bottom panels easily replaced in that event. Plan details show how different conditions allow for removal of panels, including around interior and exterior doors and windows, corners, and intersections. The method to remove the interior panels is clear and works in each condition, while the wall cavity remains clear and completely inside the exterior insulation envelope for access by all systems.

The exterior wall cavity space, protected by the complete exterior panel, is therefore fully usable for mechanical, plumbing, electrical/data, or other new systems as they develop. Obsolete or worn out systems can easily be modified or replaced within the wall without destruction of the system. Both the exterior and interior panels are capable of spanning much further than typical 16" stud bays, resulting in far fewer posts, and these posts may be pre-drilled to accept passage of horizontal systems such as wiring, plumbing, duct work, etc.

In one exemplary embodiment, the structural system for supporting the interior/exterior wall panels is a bolted, post-and-frame system based on a regular module corresponding to the panel length. However, other embodiments are possible, including other regular post-and-frame systems or even existing conventional stud framing systems (not preferred) which could be accommodated by panel lengths based on a multiple of the 16" stud interval.

In accordance with one aspect of the present disclosure, a building structure comprises a frame including a plurality of vertical perimeter support members arranged about at least a portion of a perimeter of the building at equal horizontal intervals, a plurality of uniform external panels, each mounted individually as a unit to at least two vertical support members and extending horizontally therebetween, each external panel including a structural insulating panel, a vapor barrier and a finished exterior surface, and a plurality of interior panels, each mounted individually as a unit on an opposite side of the at least two vertical support members and extending horizontally therebetween, each interior panel including a finished interior surface. The at least two vertical support members and each exterior panel and corresponding interior panel define an enclosed cavity therebetween for associated electrical and mechanical systems, each interior panel being removably mounted to the vertical support members for removal as a unit to access the enclosed cavity.

The building structure can further include a plurality of interior vertical support members arranged within the perimeter of the building at equal intervals, the interior vertical support members and perimeter support members being arranged in a rectangular grid pattern. At least one vertical standard can be provided for concealing a seam between horizontally adjacent exterior panels mounted to a common vertical perimeter support member. The vertical standard can have a u-shape cross-section with outwardly extending wing portions. A sealant material can be provided between the at least one vertical standard and the finished exterior surface of at least one of the external panels. The plurality of exterior panels can be secured to the vertical supports with fasteners, and the at least one vertical standard can conceal the fasteners of at least two horizontally adjacent exterior panels mounted to a common vertical perimeter support. At least one of an electrical or mechanical building system component can be at least partially contained within the enclosed cavity. A vertical support adjacent to the at least one electrical or mechanical building system component can include a passageway extending therethrough for passage of the at least one electrical or mechanical building system component.

In accordance with another aspect, a building system comprises a plurality of vertical support members, a plurality of uniform external panels each mountable as an individual unit to at least two vertical support members, each external panel including a structural insulating panel, a vapor barrier and a finished exterior surface, and a plurality of interior panels each mountable individually as an individual unit on an opposite side of the at least two vertical support members, each interior panel including a finished interior surface. When mounted to at least two vertical support members, each exterior panel and corresponding interior panel define an enclosed cavity therebetween for associated electrical and mechanical building system components.

Each interior panel can be removably mountable to the vertical support members for removal as a unit to access the enclosed cavity. The system can further include at least one vertical standard for concealing a seam between horizontally adjacent exterior panels when mounted to a common vertical support member. The vertical standard can have a u-shape cross-section with outwardly extending wing portions. The system can further include a sealant material for sealing between the at least one vertical standard and the finished exterior surface of at least one of the external panels. At least one vertical support can include a preformed passageway for passing of an electrical or mechanical building system component.

In accordance with another aspect, a method of constructing a building structure comprises erecting a plurality of vertical support members at equal horizontal intervals, at least some of the vertical support members comprising perimeter vertical support members forming a perimeter of the building structure, mounting a plurality of uniform external panels as individual units to at least two vertical support members, the uniform external panels extending horizontally between adjacent vertical support members, each external panel including a structural insulating panel, a vapor barrier and a finished exterior surface, and mounting a plurality of interior panels as individual units to at least two vertical support members on an opposite side of plurality of uniform external panels, the interior panels extending horizontally, each interior panel including a finished interior surface. An enclosed cavity is formed between the at least two vertical support members and each exterior panel and corresponding interior panel for concealing associated electrical and mechanical building systems, and the interior panels are removably mounted to the vertical support members for removal as a unit to access to the enclosed cavity.

The method can further include installing at least one of an electrical or mechanical building systems at least partially within the enclosed cavity. Each exterior panel can be secured to a corresponding vertical support member along an edge thereof such that an exterior panel seam between two horizontally adjacent exterior panels mounted to a common vertical support member is vertically aligned with the vertical support member. The method can also include mounting a vertical standard over the exterior panel seam. The vertical standard can have a u-shape cross-section with outwardly extending wing portions. The method can include applying a sealant material between the vertical standard and the finished exterior surface of the adjacent exterior panels.

DETAILED DESCRIPTION

Figure 1:
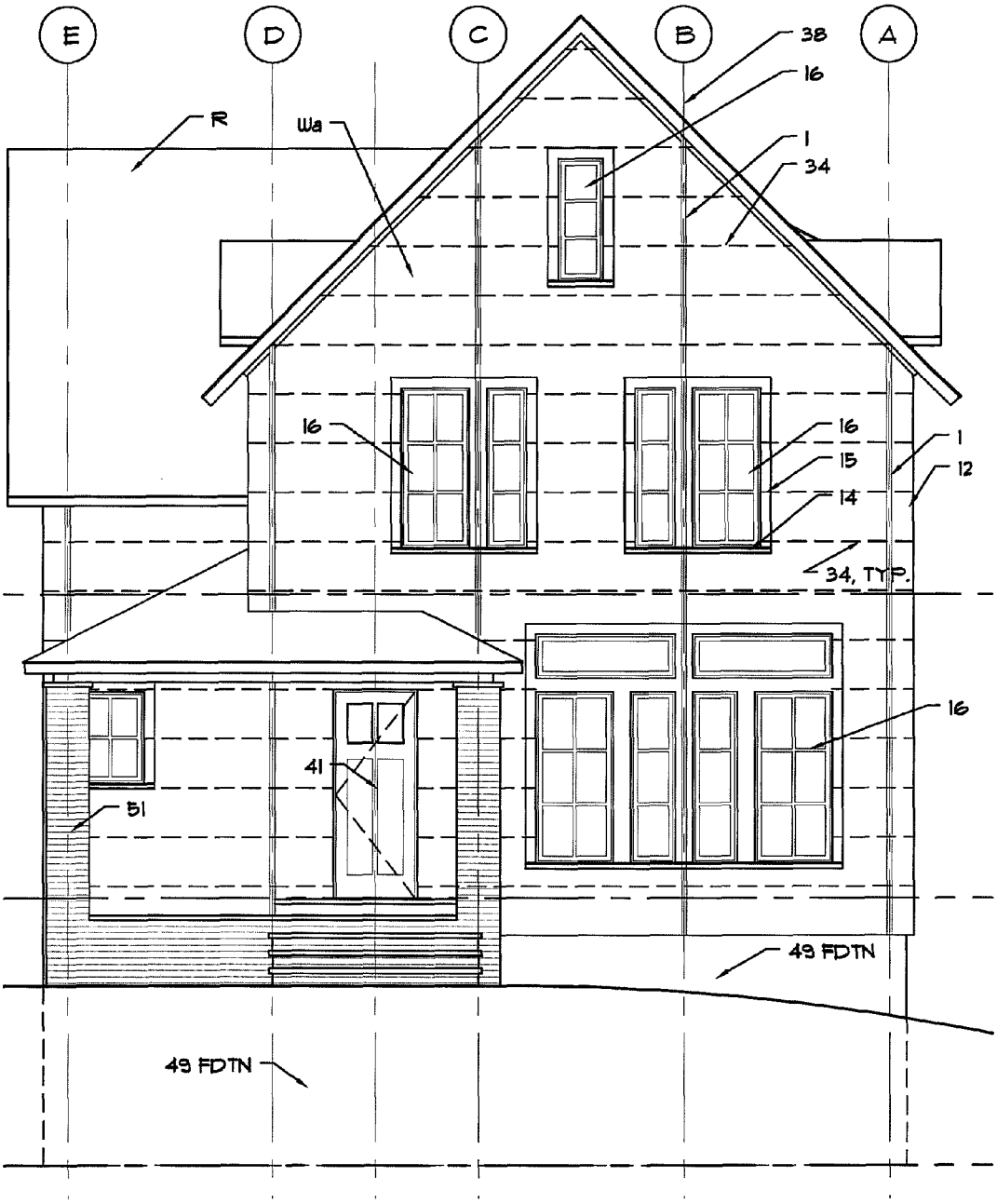
FIG. 1 is a front elevation view of an exemplary structure in accordance with the present disclosure.

The following is a listing of reference characters/numerals used in the description of the exemplary embodiment of the present disclosure:

P—Porch
Wa—Wall
R—Roofing system and/or roof insulating panel
1—Vertical standard (for example, serving as closure over vertical exterior panel joints, may be prefinished cold-formed metal or other suitable material)
WP—Wing portion
2—Sealant joint (for example, between vertical standard and edge of pre-applied and prefinished siding material)
EP—Exterior panel
3—Exterior panel siding (for example, prefinished composite or wood siding, manufactured and installed as part of an exterior panel EP)
4—Air-and-water barrier (for example, manufactured and installed as part of an exterior panel EP)
5—Structural insulating panel material (for example, manufactured and installed as part of an exterior panel EP)
6—Continuous self-adhered flashing
8—Cavity for mechanical/electrical/plumbing systems
9—Structural post (can include flat interior and exterior faces suitable for fastening, spaced apart based on module, e.g., panel length)
9C—Corner structural post
10—Interior removable panel (can include bottom edge brace; panels of several specific heights)
11—Vertical rabbeted spacer (for example, made of wood or structural composite material, provides end closure for interior panels)
12—Corner panel (can be pre-mitered and glued exterior corner panel with consistent dimension)
13—½ partition divider (for example, can be used as jamb)
14—Window sill below
15—Exterior window casing over butyl tape closure
16—Window Unit
18—Structural beam and rafters
19—Pre-formed holes at structural post for passage of horizontal systems
20—Hi-velocity air-conditioning system or other HVAC
21—Plumbing supply
22—Electrical, data, audio
23—Integrated hot-water heat supply register
24—Screwed, removable connection to structural or intermediate supports
25—Attachment to foundation at post base
F—Floor system and structure
27—Rabbet to accept wall panel
28—Pre-assembled head jamb
29—1" upstand against water infiltration
30—Pressure-equalization chamber
31—Lag screw per structural requirements
32—Metal bracket
33—Screw
34—Panel joint
35—Partition divider on module grid
36—Secondary steel support member
37—2× blocking for partition attachment
38—Grid centerline of regular building module
40—Video panels
41—Door unit
42—Wood or composite reinforced horizontal strut with/without finish
43—Wood or composite shoe mold
45—Pre-mitered wood or composite partition corner
46—Wood or composite top plate
47—2× second top plate
48—Runner for steel studs
49—FDTN: Foundation system
50—Fire stop blocking at floor levels
51—Brick Pier
EW—Exterior wall
PW—Partition wall
RS—Reinforcing strut At the outset, it should be appreciated that the present exemplary building system includes, among other things, frame components and panel/partition components. The frame components generally include vertical supports (e.g., posts) spaced apart in a generally uniform grid pattern, and horizontal supports (e.g., beams) extending between the posts along grid lines extending therebetween. The panel/partition components, which can include both internal and external panels, are mounted to the posts and/or beams to form walls to both enclose the structure and partition the interior of the enclosed structure into one or more rooms or spaces.

In the exemplary embodiment, each exterior wall is comprised of at least two panels (exterior and interior) mounted on opposite sides of the vertical supports such that an enclosed space bounded by the panels and the vertical supports is created. This enclosed space can be used for electrical and/or mechanical systems such as electrical wiring, plumbing, HVAC ducts and conduits, etc. The panels are removably mounted such that changes to either the panels or the electrical/mechanical or other systems within the wall can readily be made. The exterior panels can include weatherproofing elements and an exterior finished surface such as any of a variety of siding materials. Similarly, the interior panels can include a finished interior surface such as any of a variety of interior wall finishes such as wood, gypsum, plaster, leather, suede etc. Interior walls generally are framed with composite posts at the building module and certain secondary steel support members such as runners at the floor/ceiling or bracing around openings. The wall surface is made up of interior panels forming each side thereof. Further details of the interior and exterior panels will be described below. As will be appreciated, the external and internal panels can have a module length corresponding to the grid spacing.

With reference to FIG. 1, an exemplary structure S is illustrated. As will become apparent throughout the remainder of the description, the structure S is constructed on a grid defined by lines denoted by a letter or number within a circle. In FIG. 1, vertical grid lines A, B, C, D, and E are visible. The physical dimensions of each grid square can be any desired dimension, but typically may be 7'-4" by 7'-4" horizontally. Basing the various components of the exemplary system on a common grid allows for the components to be more easily produced and facilitates interchangeability between components.

The structure S of FIG. 1 includes many of the common features of a residential structure including a foundation system FDTN, a porch P, walls Wa and a roof R. A plurality of windows Wi and a door are also present. In general, the exemplary structure S in accordance with the present disclosure outwardly appears to have many of the same visual characteristics as a conventional stick-built residential building.

Figure 2:
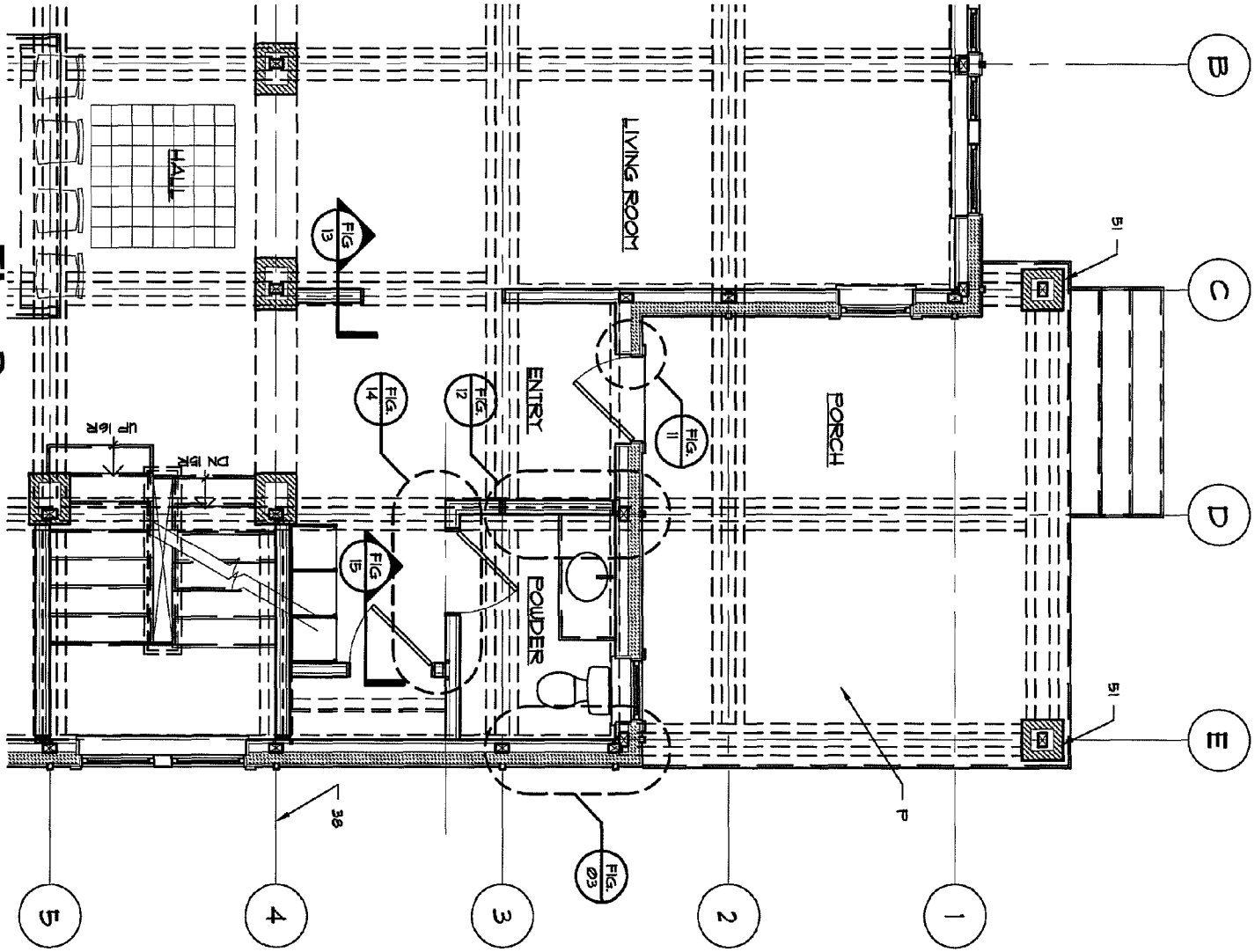
FIG. 2 is a plan view of a portion of the exemplary structure of FIG. 1.

FIG. 2 is a portion of an exemplary floor plan of the structure S. The grid arrangement of the structure S is evident and identified by the circled numbers and letters at the top and right sides of FIG. 2. Grid line reference numbers/letters appear in many of the drawings where appropriate for ease of reference, but are not further utilized in the following description.

Figure 3:
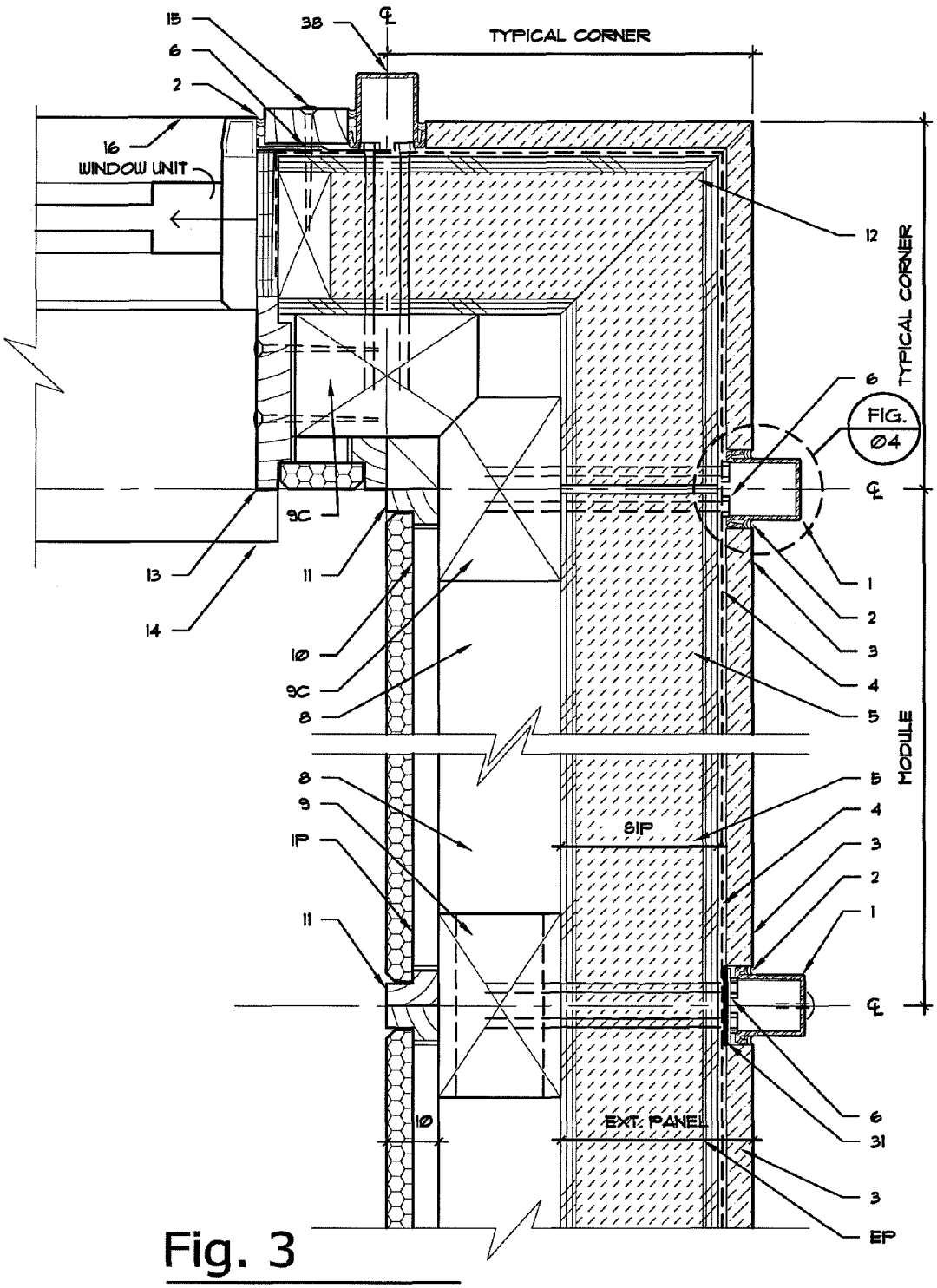
FIG. 3 is an enlarged portion of the plan view of FIG. 2.

With reference to FIG. 3, which is an enlarged portion of FIG. 2, the exemplary structure S begins with a plurality of structural posts 9 arranged about the grid points (e.g., intersection of grid lines) noted above. The structural posts 9 can be supported in a variety of ways, such as upon a continuous bearing foundation wall through a bolted post-base connection. In some embodiments, the structural posts 9 can be steel or wood posts, but any suitable material can used. The structural posts 9 can be of various sizes and various lengths, depending on the design of the structure. In some arrangements, an individual structural post or post can be omitted, with adjacent structural posts being reinforced, to thereby create larger open spaces than the nominal grid dimensions. As will be appreciated, the structural posts can be configured to accommodate a wide variety of structure S designs.

FIG. 3 illustrates a plan view of a corner portion of the structure S. A pair of corner posts 9C each have a mating beveled edge for arranging the corner posts 9C in abutting configuration about a grid point. Meanwhile, a standard post 9 is spaced along a gridline from the corner posts 9C. Standard post 9 is generally rectangular in cross-section. Of course, the standard posts can have any suitable cross-sectional shape.

Interior panels 10 are mounted to an inside surface of posts 9. To this end, rabbeted spacers 11 are provided. Rabbeted spacers 11 are mounted vertically on posts 9 and/or 9C and provide end closure for the interior panels 10 as will be further described below.

Exterior panels EP are mounted to an outside surface of posts 9 and/or 9C such as with lag screws 31. Each exterior panel EP generally includes a prefinished siding material 3, an air and water barrier 4, and a structural insulating panel 5. A pre-mitered exterior corner panel 12 joins exterior panels on adjacent side of a corner of the structure S. Lateral edges of the exterior panels can include continuous self-adhering flashing 6 for sealing a joint 34 between adjacent exterior panels EP. Joints 34 between adjacent exterior panels EP are further sealed and/or concealed by a vertical standard 1.

Figure 4:
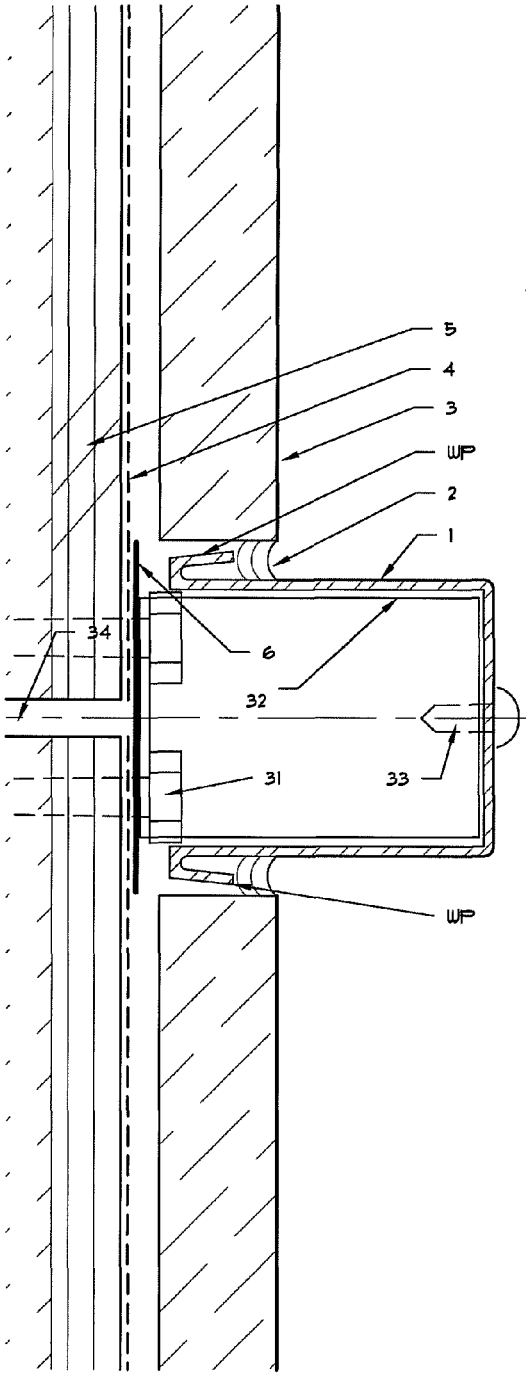
FIG. 4 is an enlarged portion of FIG. 3.
Figure 5:
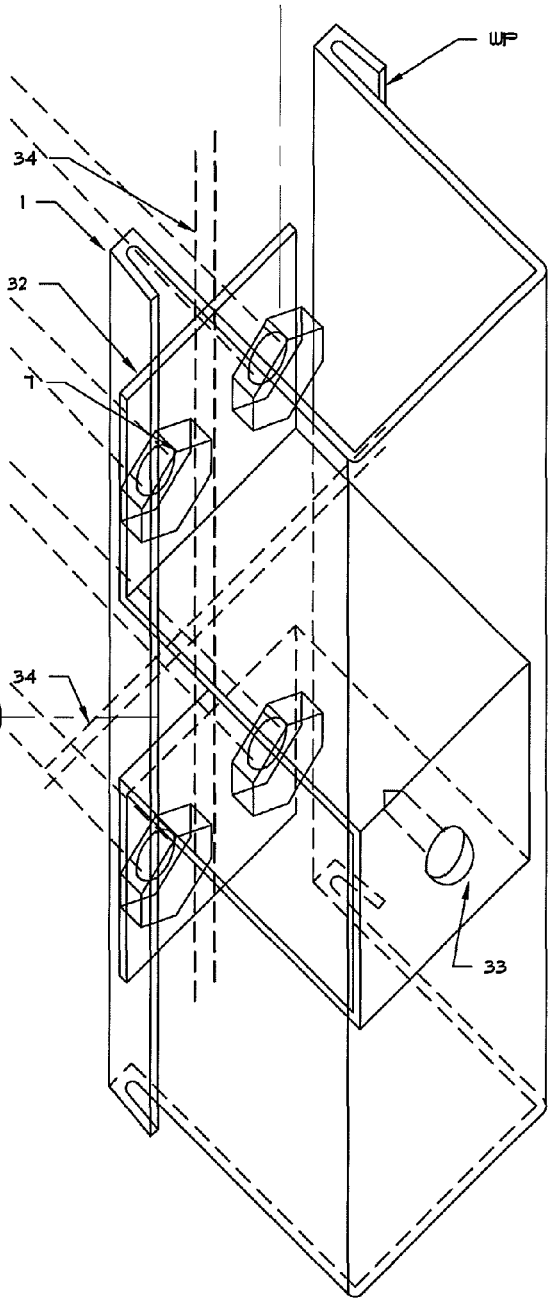
FIG. 5 is an axonometric view of a vertical standard in accordance with the present disclosure.

With further reference to FIGS. 4 and 5, vertical standard 1, which can be prefinished cold-formed metal or the like, for example, has a general u-shape cross-section with terminal ends of the u-shape being turned outwardly and back along the side of the u-shape cross-section. The outwardly turned edges of the vertical standard for respective longitudinally extending wing portions WP that can flex to accommodate a variation in tolerance between adjacent exterior panels along the height of the structure, and/or variation in tolerance between respective joints of the structure. In addition, wing portions provide a backing for application of a sealant material 2 for sealing the vertical standard to adjacent surfaces of respective external panels EP and serve to stiffen the vertical standard.

Vertical standard 1 generally extends the height of the structure (see FIG. 1) to conceal both the joints between adjacent exterior panels EP and the fasteners 7 and to provide another water-resistant seal to protect the panel joint and the structural panel fasteners concealed by the standard. Each vertical standard 1 can be a single piece, or can be comprised of several pieces. In the illustrated embodiment, a plurality of vertically spaced apart brackets 32 (best seen in FIG. 5) support the vertical standard 1. One or more fasteners 33 secure the vertical standard to each bracket 32.

Figure 6:
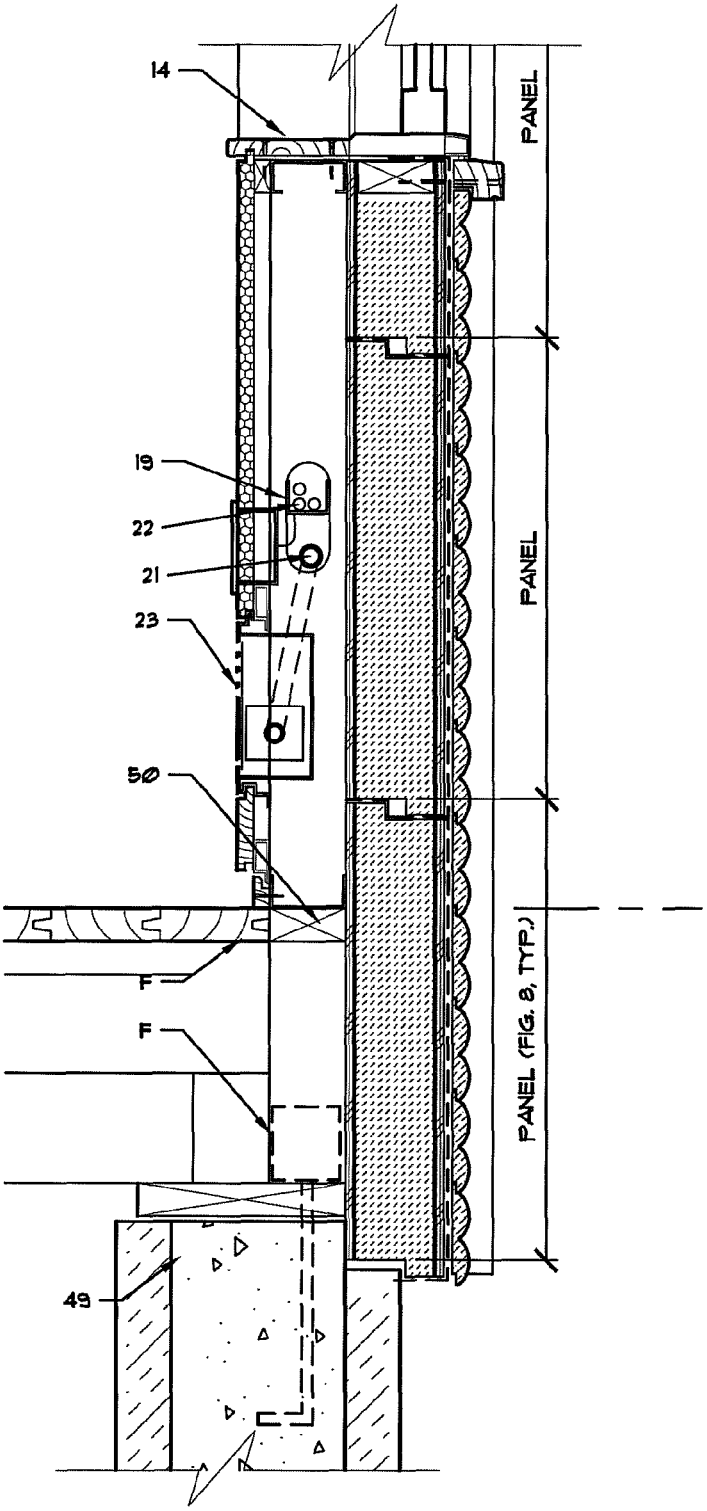
FIG. 6 is a horizontal cross-sectional view of a portion of an exterior wall in accordance with the present disclosure.
Figure 7:
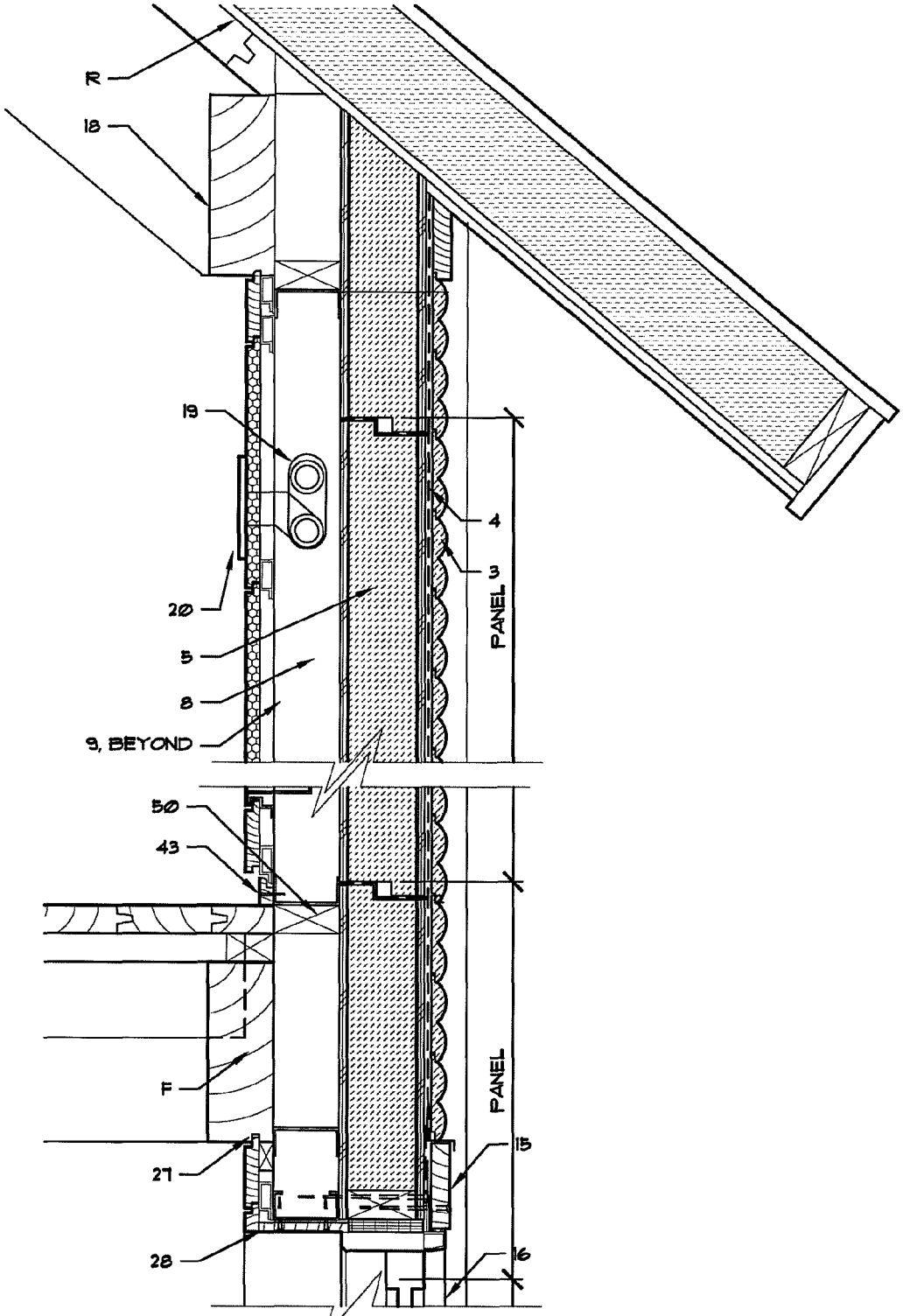
FIG. 7 is a vertical cross-sectional view of a portion of an exterior wall and roof structure in accordance with the present disclosure.

Turning now to FIGS. 6 and 7, which depict lower and upper portions of the same exterior wall of structure S, further details of the exemplary building system will be described. Beginning with FIG. 6, a floor system 26 which can be an exposed structural decking system with exposed beams (since the building systems can be effectively concealed in the walls they do not need to run across the ceiling), or a conventional floor system including joists and sheathing, etc. extends horizontally and is supported by a foundation system 49, which can be a typical basement or slab foundation. Structure S is supported directly by the foundation system 49.

Figure 8:
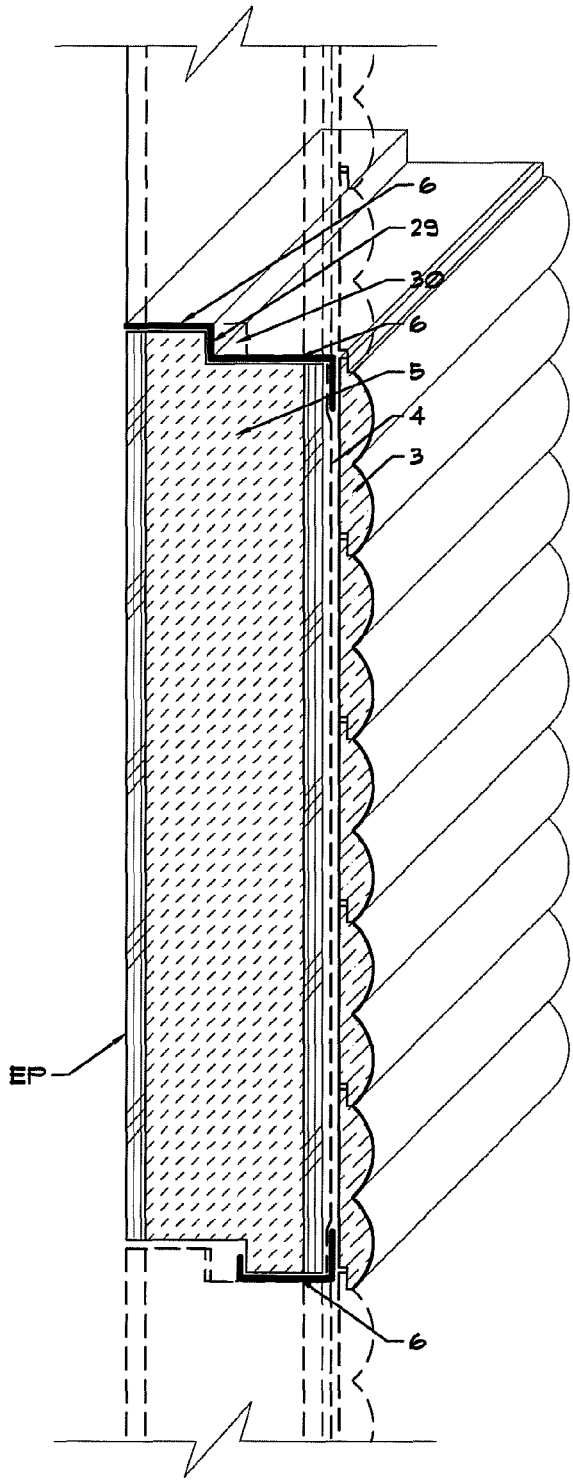
FIG. 8 is a partial cross-sectional view of an exemplary exterior wall panel in accordance with the present disclosure.

FIGS. 6 and 7 are vertical cross-sectional views taken through the structure at a position not including posts 9 and/or 9C. Therefore, the manner in which the exterior and interior panels are joined together in the vertical direction is visible. As can be seen, each exterior panel EP has a rabbeted upper and lower surface for mating with a corresponding rabbeted lower or upper surface of an adjacent exterior panel EP. As best seen in FIG. 8, the exterior panels EP are arranged in shiplap fashion such that an upstand 29 is created to prevent water infiltration. In addition, a pressure equalization chamber 30 is created between respective rabbeted portions of mating exterior panels to keep a pressure differential from driving water through the wall. Continuous self-adhering flashing 6 further enhances weatherproofing of the horizontal exterior panel joints.

As best seen in FIGS. 6 and 7, post 9 includes pre-formed holes 19 or other openings for passing electrical, data, or other wiring 22, plumbing 21, etc. between adjacent interior chambers. In addition, it will be appreciated that certain interior panels IC can be replaced by specialized panels that include pre-configured portions of a building system, such as an integrated hot-water heat supply register 23. Other specialized panels can include an integrated continuous power strip; integrated continuous or discrete lighting; integrated video screens; and other similar components.

Turning to the remaining figures, exemplary installations of interior wall panels and other features such as doors and windows are illustrated. It will be appreciated that the various interior features of the structure S are constructed using components that allow for complete non-destructive removability of at least the interior panels 10 from both interior and exterior walls. This includes interior panels 10 adjacent doors, windows, corners etc. In some embodiments, the external panels can also be non-destructively removed by a professional or homeowner for repair and/replacement.

To facilitate such non-destructive removal of the interior panels 10, a variety of interior panel terminal components are provided for use in construction with typical stud-framing components. The terminal components are mountable to posts 9 and/or 9*c*, as well as to secondary support members composed of steel and wood or of steel or other metal. In general, the terminal components are configured to transition an edge portion of one or more interior panels to either horizontally adjacent interior panels or adjacent structures such as a door jam or window frame. The terminal components can act as both a trim member for concealing end faces of the interior panels, as well as support members for supporting the interior panels. In this regard, the terminal components generally include a rabbet in which an edge portion of the one or more interior panels are configured to be received to provide a generally flush transition between interior panels or adjacent structure.

In the following description, the terminal components include i) vertical rabbeted spacer 11, ii) one-half partition divider 13, iii) partition divider 35, and iv) pre-mitered partition corner 45. Each of these components are configured to provide a clean and non-destructively removable installation of the interior panels to the stud walls and/or posts 9 and/or 9*c*, as will now be described.

Figure 9:
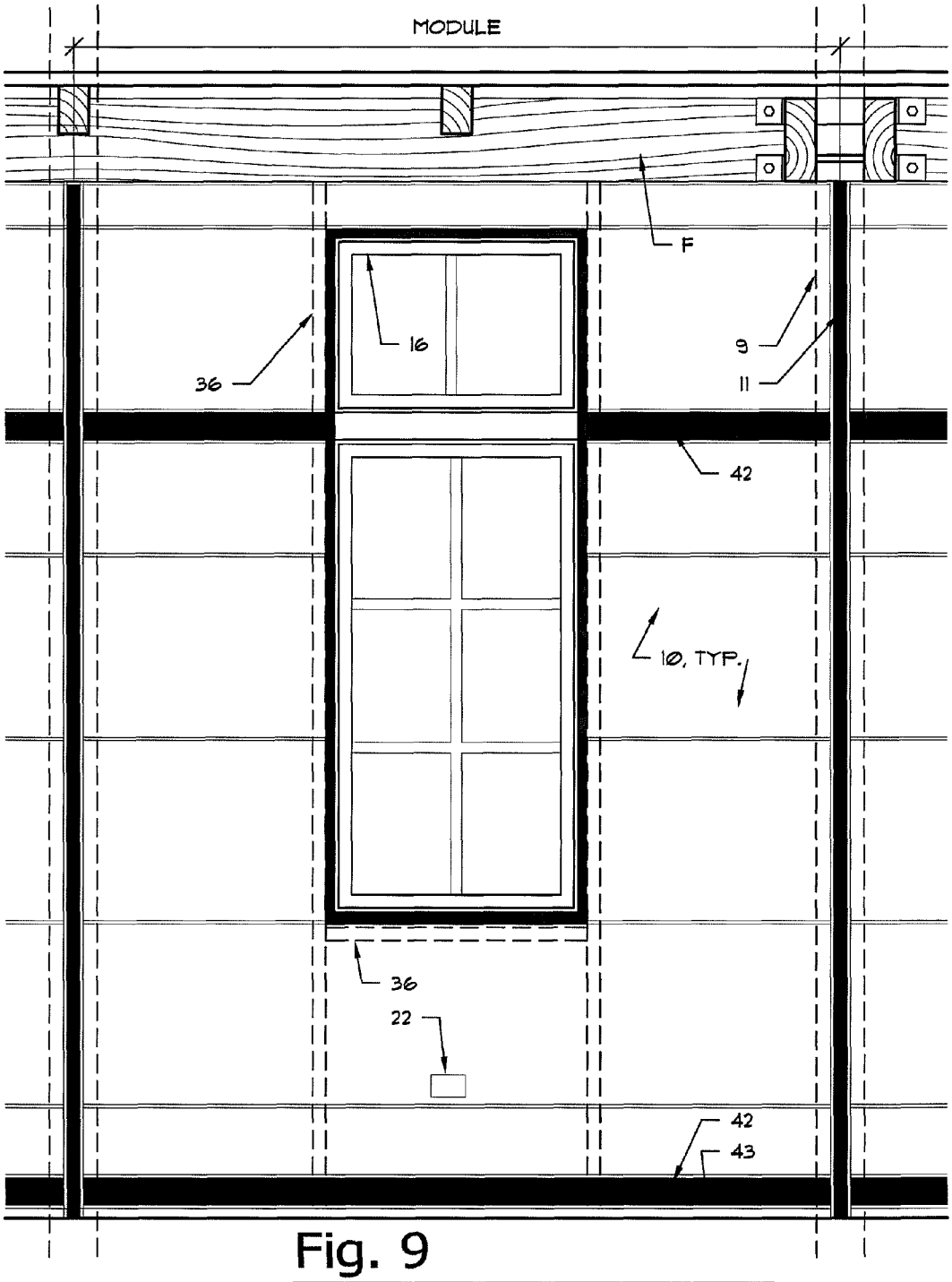
FIG. 9 is an elevation view of an interior wall including a window in accordance with the present disclosure.

As shown in FIG. 9, which is an elevation view of an exemplary window installation in accordance with the present disclosure, vertical rabbeted spacers 11 extend along vertical gridlines downward from the floor structure 26 at the junction of two adjacent columns of interior panels 10. As will be appreciated, the vertical rabbeted spacers 11 can be wood or any other suitable material, and include two rabbets for receiving respective interior panels on each side thereof. Secondary steel support members 36 are installed for suitable blocking and bracing to form a window opening or frame, to support the exterior panel edges in which window unit 16 can be mounted in conventional fashion.

Figure 10:
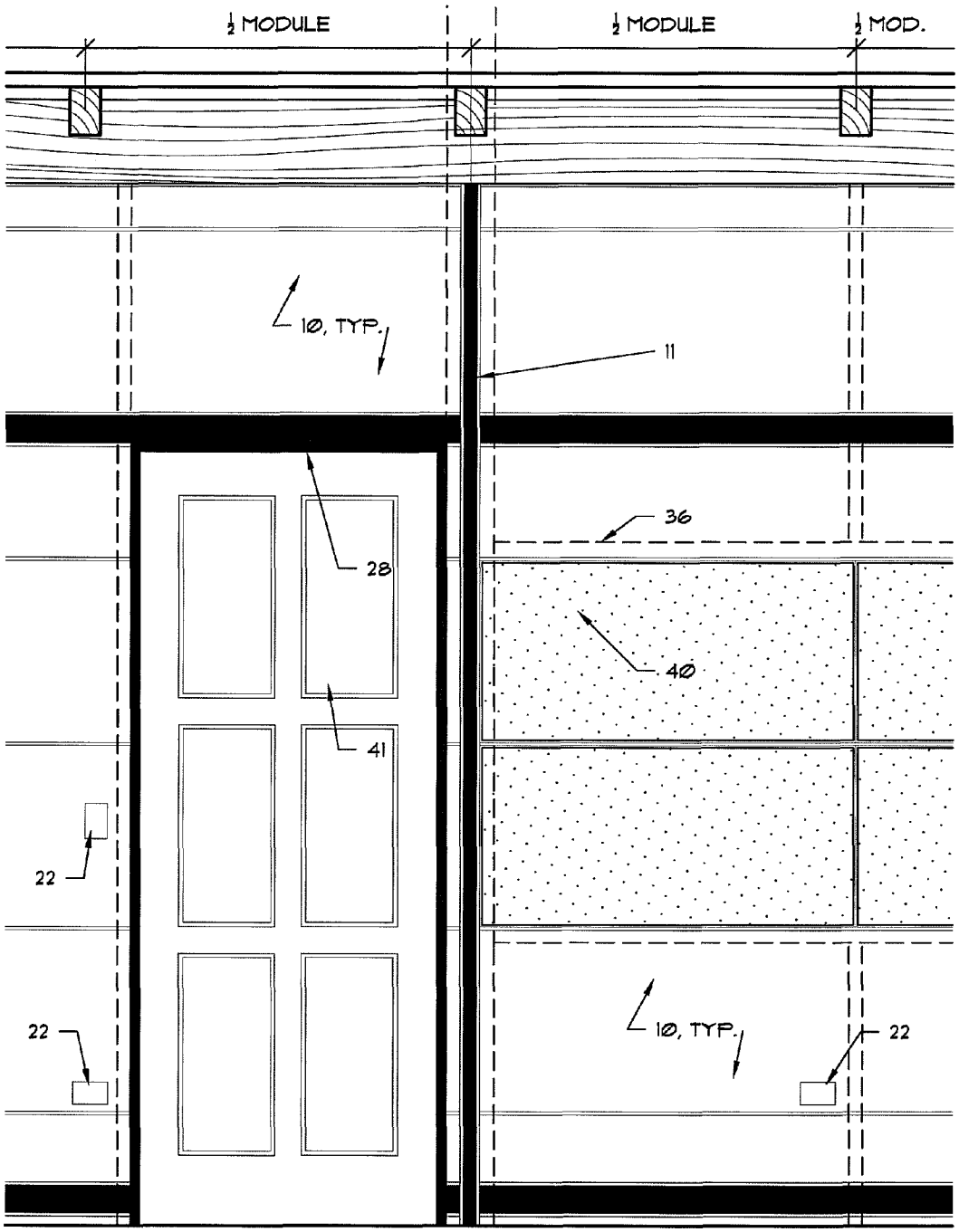
FIG. 10 is an elevation view of an interior wall including a door in accordance with the present disclosure.
Figure 11:
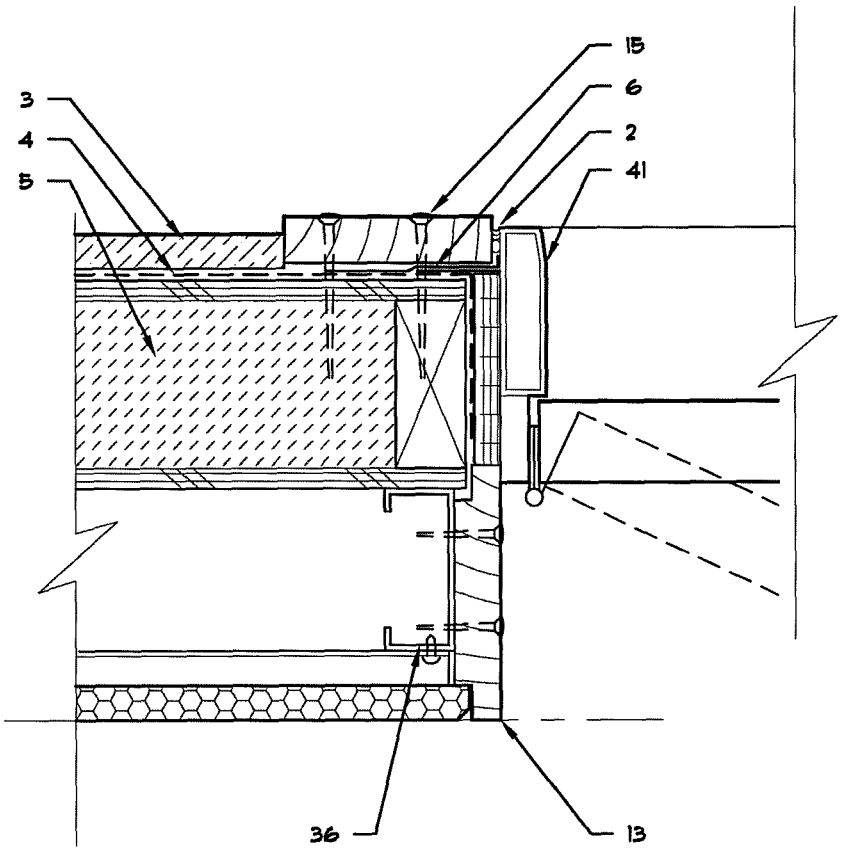
FIG. 11 is a plan view of an exterior wall and exterior door in accordance with the present disclosure.

Similarly, referring now to FIG. 10, door unit 41 is mounted in a door frame bounded by secondary steel support members 36, which themselves are secured between the top and bottom or two sides of the frame structure (e.g. flooring structure, etc.) in a conventional manner. With additional reference to FIG. 11, it will be appreciated that the door unit 41 can be installed at a wide variety of locations by forming a door frame through terminating interior and exterior panels 10 and EP with suitable terminal components at the desired location.

To this end, exterior panel EP is terminated at a suitable location and exterior casing 15 is face-screwed or otherwise secured to the exterior panel adjacent the door opening. Interior panel 10 is similarly terminated and a secondary steel support member 36 is installed for additional blocking adjacent the door frame. A one-half partition divider 13 is installed to capture interior panel edges at the door opening. Further, a secondary steel support member 42 extends across the top of the door opening. Door unit 41 is secured to the exterior panels which attach to the secondary steel support member along with adjacent terminal components. Although only the hinge side of the door unit is illustrated, it will be appreciated that the framing of the latch side of the door unit can be done in a similar manner.

Figure 12:
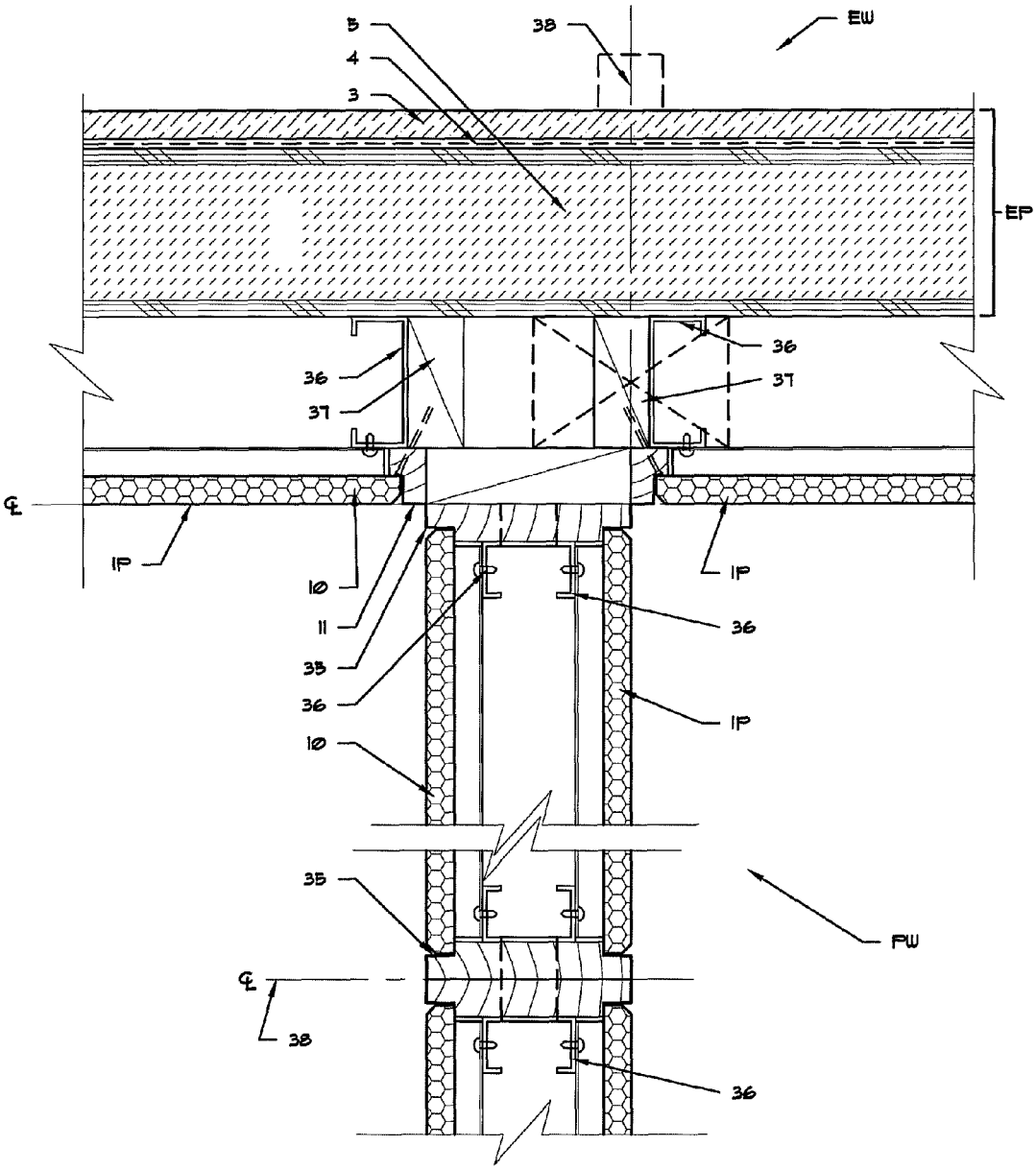
FIG. 12 is a plan view of an interior partition wall in accordance with the present disclosure.
Figure 15:
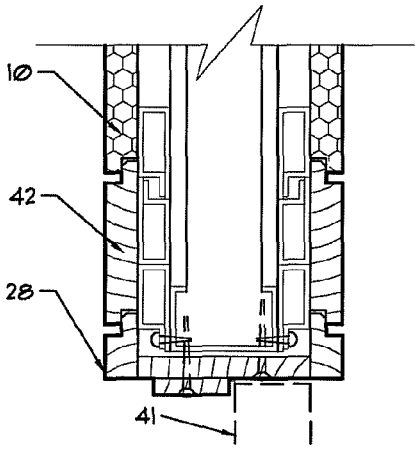
FIG. 15 is a cross-sectional view of an interior wall adjacent a door frame in accordance with the present disclosure.

Turning now to FIGS. 12-15, construction of various interior partition wall conditions will be described. FIG. 12 is a plan view illustration of the junction of an exterior wall EW and an interior partition wall PW. As such, exterior wall EW extends horizontally while the partition wall PW extends vertically downward from the exterior wall EW. The exterior wall EW includes the afore-described external wall components such as exterior panels EP and interior panels 10. The interior panels 10 of the exterior wall EW are terminated via respective vertical rabbeted spacers 11. Steel studs and 2× wood blocking are installed in the cavity 8 for reinforcing the wall at the junction. A partition divider 35 is secured to the 2× wood blocking and includes rabbeted edge portions for receiving the interior panels 11 of the partition wall.

Figure 16:
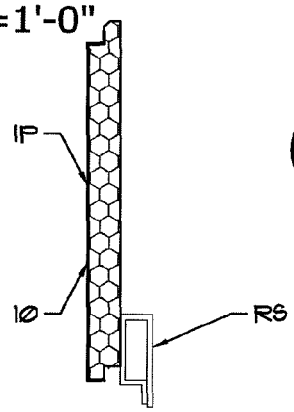
FIG. 16 is a cross-sectional view of an interior wall panel in accordance with the present disclosure.
Figure 13:
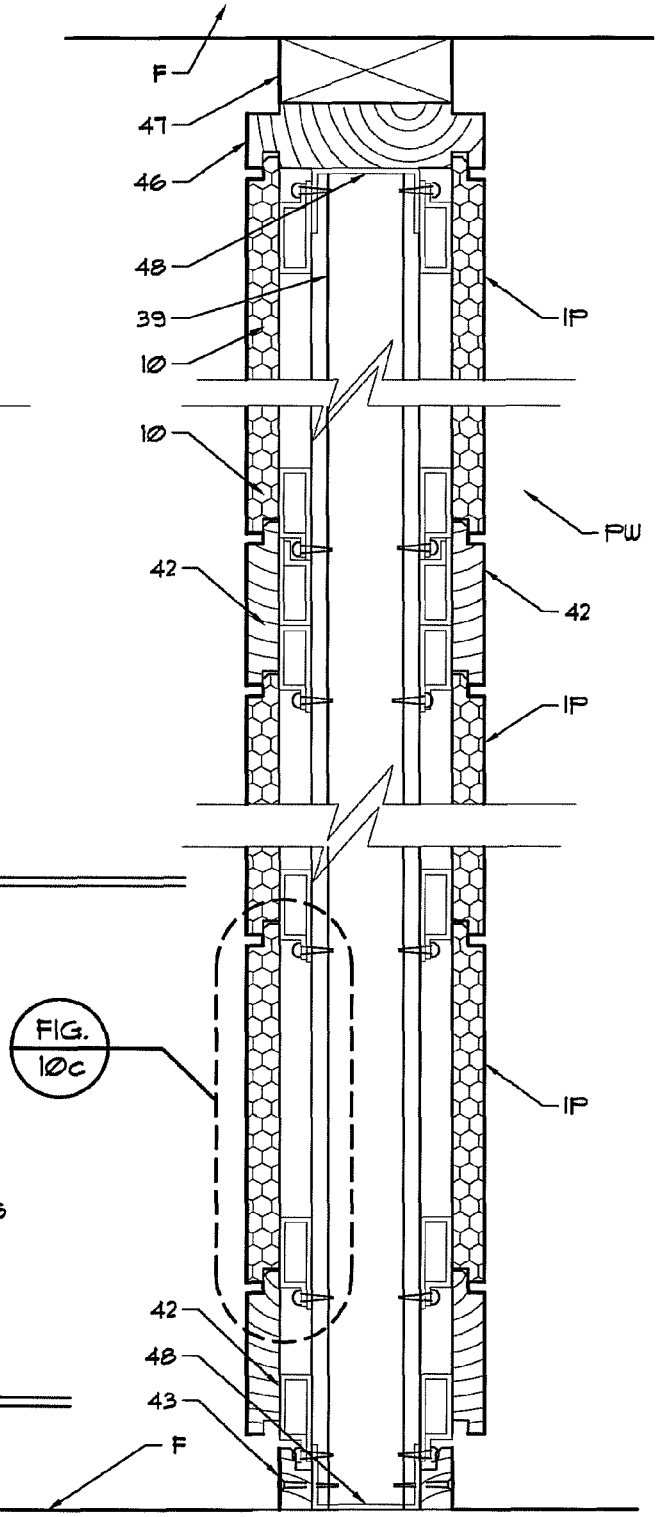
FIG. 13 is a cross-sectional view of the interior partition wall of FIG. 12.

FIG. 13 illustrates a vertical cross-sectional view of an exemplary interior partition wall PW. The exemplary partition wall PW includes a runner 48 for secondary steel support members mounted to the floor or other supporting surface. Base molding 43 is secured to the runner 48 with exposed fasteners and allows for some adjustment of the wall to sloping or un-level floors. Each interior panel 10 includes a panel surface with an upward-facing channel leg to slide under the panel above, a downward-facing projection to capture the panels below, and a reinforcing strut RS (see FIG. 16) which strengthens the panel and also provides the back surface capturing the panel below (reinforcing strut RS and downward facing projecting defining a channel or recess in which the upward-facing channel leg of panel below can be received). This allows for a continuous seal between panels needed to slow the progress of fire, contain sound and air drafts between discrete rooms, and other critical functions of typical room walls. A plurality of interior panels 10 are mounted to opposite sides of the steel studs 36 to form the major surfaces of each side of the partition wall PW. As illustrated, some of the steel studs include preformed holes for passing of electrical and/or mechanical systems within the partition wall, such secondary steel support members being identified by reference numeral 36. Wood or composite reinforced horizontal strut 42 is provided at a typical height over any openings in the interior wall IW. The horizontal strut 42 in the illustrated embodiment includes a finished exterior surface. This special reinforcing panel spans horizontally between vertical partition posts to reinforce any secondary steel support members for greater wall heights without an increase in wall thickness (Note: conventional stud walls spanning from floor to ceiling generally need to grow from 2×4 to 2×6 framing if the wall height exceeds nine feet). A top plate 46 is secured to a wood 2×4 plate 47 to thereby join the partition wall PW to the ceiling joist or other structure (e.g., floor structure 26).

Figure 14:
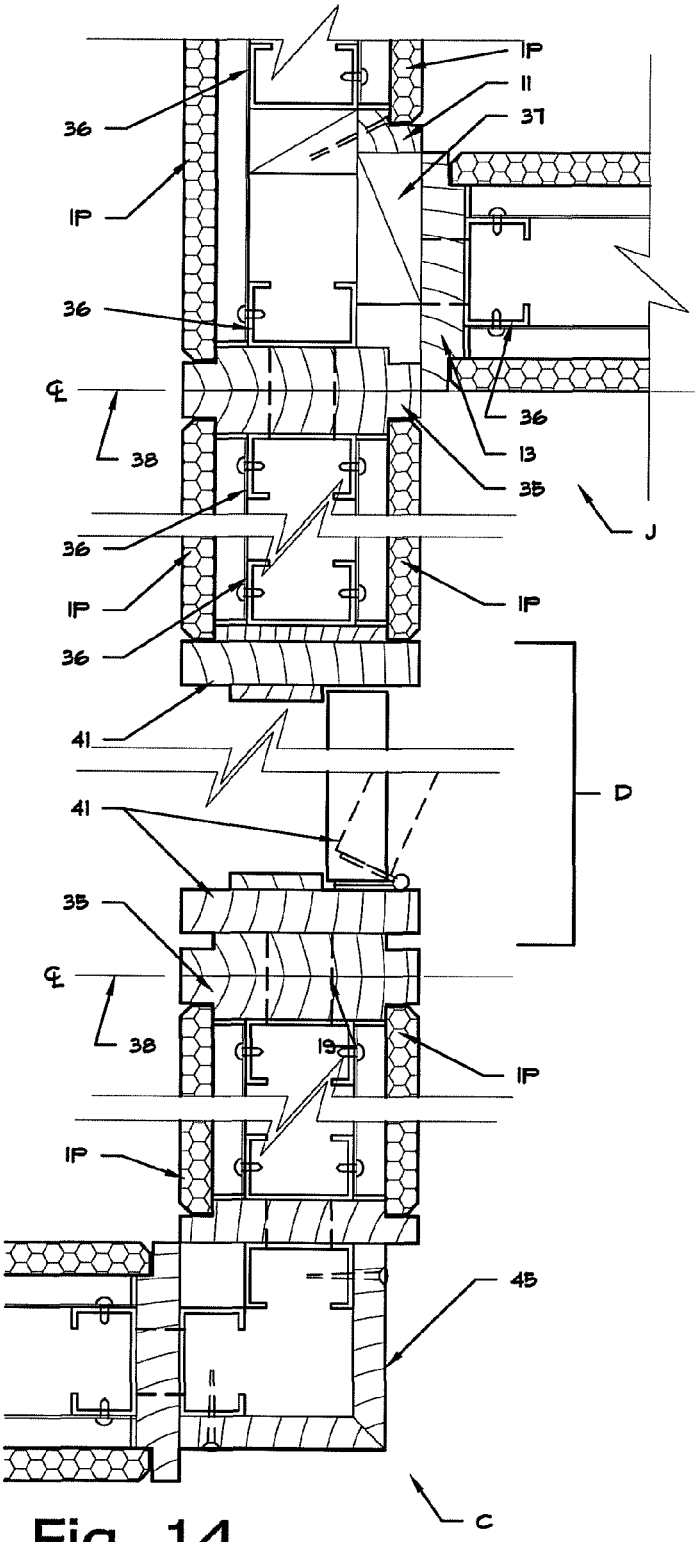
FIG. 14 is a plan view of an interior wall intersecting another interior wall and having a door and corner in accordance with the present disclosure.

FIG. 14 illustrates several other conditions including a junction J of two interior partition walls, an interior door jamb with door unit 41, and an interior wall inside/outside corner construction C. Beginning with the junction of two interior walls J, it will be appreciated that the partition wall PW terminating at the junction is secured to the other partition wall PW via a partition divider 35 that in turn is mounted to 2×4 blocking 37 of the non-terminating partition wall. The non-terminating partition wall is further configured such that the interior panels 10 terminate at suitable locations with either a one-half partition divider 13 or a partition divider 35, which combine with secondary steel support members 36 in a typical fashion as either posts or half-posts adjacent the junction J to properly support the various components.

The door frame D and door unit 41 construction similarly includes placing secondary steel support members 36 at appropriate locations to support the door unit and to attach the termination of the interior panels on respective sides of the partition wall PW such that they properly mate with the door unit 41. Door unit 41 includes both the door frame and the door, and is installable as a unit between.

Corner C is constructed by a pair of half-posts including partition dividers 35 and secondary steel support members 36 disposed at right angles to each other. A pre-mitered corner is installed and secured with exposed screws to a supplemental support member 36 and forms the outside of the corner C. Each partition wall PW is then joined to a respective one of the right angle steel studs 36 via a partition divider 35.

It should be appreciated that construction of many features of the exemplary structure is simplified by having interior/exterior wall joints, interior wall joints, doors and/or corners aligned on grid points such that the interior and/or exterior panel can be used generally without modification.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A building comprising:

a frame including a plurality of vertical perimeter support members arranged about at least a portion of a perimeter of the building at equal horizontal intervals;

a plurality of uniform external panels, each mounted individually as a unit to at least two vertical support members of the plurality of vertical support members and extending horizontally therebetween, each external panel including a structural insulating panel, a vapor barrier and a finished exterior surface;

a plurality of interior panels, each mounted individually as a unit on an opposite side of the at least two vertical support members and extending horizontally therebetween, each interior panel including a finished interior surface, a panel surface with an upward-facing channel leg configured to slide under an adjacent interior panel above, and a downward-facing projection and a reinforcing strut defining therebetween a recess configured to receive an upward-facing channel leg of an adjacent interior panel below;

wherein the at least two vertical support members and each exterior panel and corresponding interior panel define an enclosed cavity therebetween for associated electrical and mechanical systems; and wherein each interior panel is removably mounted to the vertical support members for removal as a unit to access to the enclosed cavity.

2. The building of claim 1, further comprising a plurality of interior vertical support members arranged within the perimeter of the building at equal intervals, the interior support members and perimeter support members being arranged in a rectangular grid pattern.

3. The building of claim 1, further comprising at least one vertical standard for concealing a seam between horizontally adjacent exterior panels mounted to a common perimeter vertical support member.

4. The building of claim 3, wherein the vertical standard has a u-shape cross-section with outwardly extending wing portions.

5. The building of claim 4, further comprising a sealant material between the at least one vertical standard and the finished exterior surface of at least one of the external panels, and at least one terminal component mounted to a vertical support member for transitioning at least one interior panel to an adjacent surface, the at least one terminal component including a rabbet for receiving an edge portion of an interior panel, and wherein the reinforcing strut extends horizontally across a rear surface of the interior panel opposite the finished surface of the panel, the reinforcing strut spacing the rear surface of the interior panel from the vertical support members, and the portion of the reinforcing strut defining the recess configured to space a rear surface of an adjacent interior panel below from the vertical support members.

6. The building of claim 4, wherein the plurality of exterior panels are secured to the vertical supports with fasteners, and wherein the at least one vertical standard conceals the fasteners of at least two horizontally adjacent exterior panels mounted to a common vertical perimeter support member.

7. The building of claim 1, further comprising at least one of an electrical or mechanical building system component at least partially contained within the enclosed cavity.

8. The building of claim 7, wherein a vertical support adjacent the at least one electrical or mechanical building system component includes a passageway extending therethrough for passage of the at least one electrical or mechanical building system component.

9. A building system comprising:

a plurality of vertical support members;

a plurality of uniform external panels, each mountable as an individual unit to at least two vertical support members of the plurality of vertical support members, each external panel including a structural insulating panel, a vapor barrier and a finished exterior surface;

a plurality of interior panels, each mountable individually as an individual unit on an opposite side of the at least two vertical support members, each interior panel including a finished interior surface, a panel surface with an upward-facing channel leg configured to slide under an adjacent interior panel above, and a downward-facing projection and a reinforcing strut defining therebetween a recess configured to receive an upward-facing channel leg of an adjacent interior panel below, the reinforcing strut spacing the rear surface of the interior panel from the vertical support members, and the portion of the reinforcing strut defining the recess configured to space a rear surface of an adjacent interior panel below from the vertical support members;

wherein, when mounted to at least two vertical support members, each exterior panel and corresponding interior panel define an enclosed cavity therebetween for associated electrical and mechanical building system components.

10. The building system of claim 9, wherein each interior panel is removably mountable to the vertical support members for removal as a unit to access the enclosed cavity.

11. The building system of claim 9, further comprising at least one vertical standard for concealing a seam between horizontally adjacent exterior panels mounted to a common vertical support member.

12. The building system of claim 11, wherein the vertical standard has a u-shape cross-section with outwardly extending wing portions.

13. The building system of claim 12, further comprising a sealant material for sealing between the at least one vertical standard and the finished exterior surface of at least one of the external panels.

14. The building system of claim 9, wherein at least one vertical support includes a preformed passageway for passing of an electrical or mechanical system.

15. A method of constructing a building structure comprising:

erecting a plurality of vertical support member at equal horizontal intervals, at least some of the vertical support members comprising perimeter vertical support members forming a perimeter of the building structure;

mounting a plurality of uniform external panels as individual units to at least two vertical support members of the plurality of vertical support members, the uniform external panels extending horizontally between adjacent vertical support members, each external panel including a structural insulating panel, a vapor barrier and a finished exterior surface; and mounting a plurality of interior panels as individual units to at least two vertical support members on an opposite side of plurality of uniform external panels, the interior panels extending horizontally, each interior panel including a finished interior surface, a panel surface with an upward-facing channel leg configured to slide under an adjacent interior panel above, and a downward-facing projection and a reinforcing strut defining therebetween a recess configured to receive an upward-facing channel leg of an adjacent interior panel below, the reinforcing strut spacing the rear surface of the interior panel from the vertical support members, and the portion of the reinforcing strut defining the recess configured to space a rear surface of an adjacent interior panel below from the vertical support members;

wherein an enclosed cavity is formed between the at least two vertical support members and each exterior panel and corresponding interior panel for concealing associated electrical and mechanical building system components; and wherein the interior panels are removably mounted to the vertical support members for removal as a unit to access the enclosed cavity.

16. The method of claim 15, further comprising installing at least one of an electrical or mechanical building systems at least partially within the enclosed cavity.

17. The method of claim 15, wherein each exterior panel is secured to a corresponding vertical support member along an edge thereof such that an exterior panel seam between two horizontally adjacent exterior panels is vertically aligned with the vertical support member.

18. The method of claim 17, further comprising mounting a vertical standard over the exterior panel seam.

19. The method of claim 18, wherein the vertical standard has a u-shape cross-section with outwardly extending wing portions.

20. The method of claim 19, further comprising applying a sealant material between the vertical standard and the finished exterior surface of the adjacent exterior panels.

* * * * *